United States Patent [19]

Theobald

[11] 4,152,130

[45] May 1, 1979

[54] PRODUCTION OF LIQUID OXYGEN AND/OR LIQUID NITROGEN

[75] Inventor: Alan Theobald, Purley, England

[73] Assignee: Air Products and Chemicals, Inc., Allentown, Pa.

[21] Appl. No.: 887,101

[22] Filed: Mar. 16, 1978

[30] Foreign Application Priority Data

Mar. 19, 1977 [GB] United Kingdom ..... 11755/77

[51] Int. Cl.[2] ..... F25J 3/04

[52] U.S. Cl. ..... 62/18; 62/30; 62/38

[58] Field of Search ..... 62/13–15, 62/18, 30, 38

[56] References Cited

U.S. PATENT DOCUMENTS

| | | | |
|---|---|---|---|
| 2,552,559 | 5/1951 | Jenny et al. | 62/13 |
| 2,712,738 | 7/1955 | Wucherer et al. | 62/13 |
| 3,098,732 | 7/1963 | Dennis | 62/38 |
| 3,677,019 | 7/1972 | Olszewski | 62/30 |
| 3,864,926 | 2/1975 | Collins | 62/38 |

FOREIGN PATENT DOCUMENTS

| | | | |
|---|---|---|---|
| 1325881 | 8/1973 | United Kingdom | 62/38 |

*Primary Examiner*—Norman Yudkoff
*Attorney, Agent, or Firm*—Ronald B. Sherer; Barry Moyerman

[57] ABSTRACT

Liquid oxygen and/or liquid nitrogen are made by removing carbon dioxide and water vapor from air, compressing the purified air in a re-cycle compressor and dividing the purified compressed air into first and second streams. Part of the first stream is expanded in a first expander and the refrigeration produced is used to cool both the first and second streams in a first heat exchanger. On leaving the first heat exchanger, the second stream is expanded in a second expander and the refrigeration produced is used to liquify at least part of the remainder of the first stream. The liquid stream is expanded and introduced into a fractionation column from which liquid nitrogen and/or liquid oxygen can be withdrawn. Expanded air from the first and second expanders is returned to the re-cycle compressor although part of the expanded air from the second expander is preferably introduced into the fractionation column. The invention is particularly suited to installations producing in excess of 100 tons of liquid per day and, at this size, preferred designs offer an estimated 5½ to 9% power savings over the known prior art.

1 Claim, 1 Drawing Figure

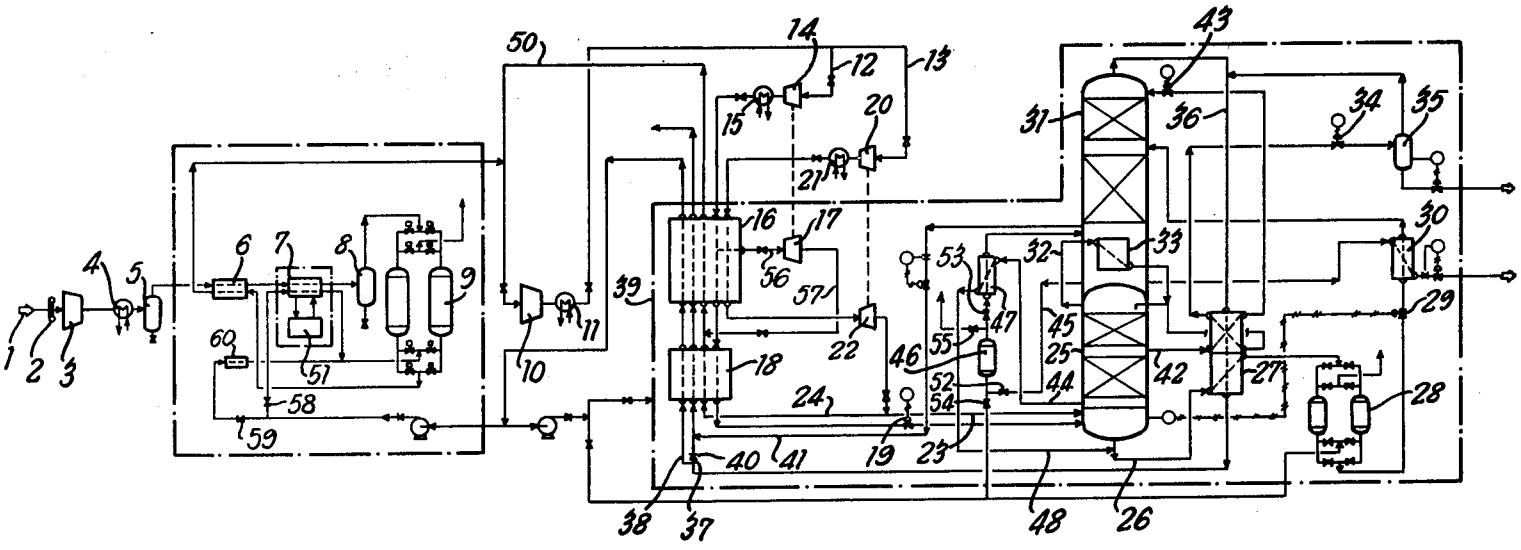

PRODUCTION OF LIQUID OXYGEN AND/OR LIQUID NITROGEN

BACKGROUND OF THE INVENTION

1. Field of the Invention

This invention relates to the production of liquid oxygen and/or liquid nitrogen.

As energy has become more expensive, enormous effort has been expended in trying to reduce the specific power consumption of installations designed to produce liquid oxygen and/or liquid nitrogen.

2. Description of the Prior Art

Generally, installations for producing in excess of 100 tons a day of liquid oxygen or liquid nitrogen comprise an air separation unit for producing gaseous nitrogen and gaseous oxygen and a liquifier for liquifying one or both gaseous products. The specific power consumption of such plant is typically 900 kW-hr/MT (kilowatt hours per metric ton) of liquid produced.

UK Patent specification No. 1,325,881 describes an installation for obtaining liquid oxygen and/or liquid nitrogen by modifying the air separation unit and omitting the liquifier.

Unfortunately, the specific power consumption of the installations described in UK Patent specification No. 1,325,881 are high and the inventor's object was to devise a modified air separation unit which could produce liquid oxygen and/or liquid nitrogen without a liquifier and would, at least in its preferred forms, have a specific power consumption of not greater than 850 kW-hr/MT of liquid produced.

SUMMARY OF THE INVENTION

The present invention provides a method for producing liquid oxygen and/or liquid nitrogen, which method comprises the steps of, in sequence, providing substantially dry and substantially carbon dioxide free air; liquifying a portion of said substantially dry and substantially carbon dioxide free air, feeding said liquified air together with substantially dry and substantially carbon dioxide free gaseous air into a fractionation column to separate the nitrogen and oxygen in said air; and withdrawing liquid oxygen and/or nitrogen from said column; the improvement consisting in that said portion of said substantially dry and substantially carbon dioxide free air is liquified by compressing substantially dry and substantially carbon dioxide free air in a re-cycle compressor dividing the compressed air into a first stream and a second stream; expanding a side stream of said first stream in a first expander and using the cold expanded air thus produced to cool said first stream and said second stream in first heat exchange means; expanding said second stream of cooled compressed air downstream of said first heat exchange means in second expander and passing at least a portion of the cold expanded air thus produced to further cool and/or liquify said first stream of cooled compressed air in second heat exchange means downstream of said first heat exchange means; re-cycling the expanded streams through at least one conduit to the inlet of said recycle compressor and expanding said first stream of further cooled compressed air and/or liquid in third expander and passing it to said fractionation column.

Preferably, a portion of the cold expanded air produced by expanding the second stream of cooled compressed air in said second expander is passed to said fractionation column.

Advantageously, the cold expanded air produced by expanding the second stream of cooled compressed air in said second expander is used to cool both the first stream and second streams of compressed air.

The air in the installation is preferably compressed to a maximum pressure of between 450 and 1000 psia. This compression may be effected in a single stage or advantageously in steps. Thus, the first stream may, if desired, be cooled in the first heat exchanger before the side stream is expanded in the first expander and the first expander used to drive an additional compressor in the first stream upstream of the first heat exchanger. Similarly, if desired, the second stream may be further compressed by an additional compressor upstream of the first heat exchanger and driven by the second expander.

In the preferred embodiment, atmospheric air is initially compressed to between 85 and 105 psia. The compressed atmospheric air is then dried and substantially all the carbon dioxide therein removed. The pressure of the air is then increased to between 400 and 500 psia in a re-cycle compressor and is subsequently raised to between 500 and 1000 psia in each stream by a compressor driven by one of the expanders.

The feed to the column should preferably contain 15% to 30% (by moles) of liquid.

Preferably, the gaseous and liquid air enter the fractionation column at between 85 and 100 psia.

The present invention also provides an installation for producing liquid oxygen and/or liquid nitrogen which installation comprises an air pre-treatment unit for removing substantially all moisture and carbon dioxide from air; a fractionation column; means for liquifying a portion of said pretreated air and introducing said liquified air together with gaseous pre-treated air into said fractionation column; and means for withdrawing liquid oxygen and/or liquid nitrogen from said first column the improvement consisting in that said means for liquifying a portion of said pre-treated air and introducing said liquified air together with gaseous pre-treated air into said fractionation column comprises a re-cycle compressor; a first passageway and a second passageway for accomodating compressed air from the re-cycle compressor; a first expander for expanding a side stream of the compressed air in said first stream; first heat exchange means in which, in use, cold expanded air from said first expander can cool the compressed air in said first stream and said second stream; means for carrying expanded air from said first heat exchange means to the inlet of the re-cycle compressor; a second expander for expanding the cool compressed air leaving the first heat exchange means in said second stream; second heat exchange means in which, in use, at least a portion of the cold expanded air from said second expander can cool and/or liquify the compressed air leaving the first heat exchange means in said first stream; means for carrying the cold expanded air from said second heat exchange means to the inlet of said re-cycle compressor and a third expander for expanding the gaseous and/or liquid air leaving said second heat exchange means.

Preferably, the third expander in this arrangement is a throttle valve.

Advantageously, the installation includes a conduit for conveying a portion of the cold expanded air leaving the second expander to the fractionation column.

BRIEF DESCRIPTION OF THE DRAWING

The single FIGURE of the drawing is a flowsheet of a process installation employing the teachings of the present invention.

DESCRIPTION OF THE PREFERRED EMBODIMENT

For better understanding of the invention, reference will now be made, by way of example, to the accompanying flowsheet of an installation in accordance with the present invention.

Referring to the flowsheet, air enters the installation at 1, passes through filter 2, and is compressed to 101 psia in compressor 3. The compressed air is subsequently cooled in an aftercooler 4 and any condensate removed in separator 5. The compressed air is then cooled in heat exchangers 6 and 7. Any additional condensate is collected in separator 8 and any remaining water and carbon dioxide in the air are removed from the air leaving the top of separator 8 in one of a pair of switching molecular sieves 9.

The dry and carbon dioxide free air leaving molecular sieve 9 passes through heat exchanger 6 and, after joining recycle air from conduit 50, is subsequently passed to recycle compressor 10 from which it emerges at 425 psia. The compressed air is cooled to 75° F. in aftercooler 11 after which it is divided into first and second streams, 12 and 13, respectively.

First stream 12 is cooled to −271° F. before it is expanded in valve 19 and enters high pressure fractionation column 25 as liquid with a small amount of gas.

Second stream 13 is to be cooled to −271° F. before it enters high pressure fractionation column 25 as gas.

Turning to first stream 12, the air is compressed to 645 psia in compressor 14 and is subsequently cooled to 80° F. in aftercooler 15. The compressed air is introduced into the warm end of heat exchanger 16. A side stream 56 of compressed air is withdrawn from stream 12 and is expanded to 92 92 in expander 17 which is coupled to and drives compressor 14. The side stream of cold air 57 leaving the expander at −136° F. is introduced into the cold end of heat exchanger 16 where it serves to help cool the remainder of stream 12 in heat exchanger 16 to −159° F. Stream 12 is further cooled to −271° F. in heat exchanger 18 at which temperature it is a subcooled supercritical fluid. The fluid is then expanded to 92 psia through valve 19. The resulting liquid and any accompanying vapors are then introduced to high pressure column 25 which operates at 92 psia.

Turning now to second stream 13, the air is compressed to 574 psia in compressor 20 and is subsequently cooled in after-cooler 21 to 80° F. The compressed air is passed through heat exchanger 16 in which it is cooled to −159° F. The cool compressed air is expanded through expander 22 which is coupled to and drives compressor 20. The cold expanded gas emerging at −271° F and 94 psia is split into a stream 23 which is fed to high pressure column 25 and a stream 24 which is introduced into the cold end of heat exchanger 18 and joins the expanded side stream of cold air from expander 17 before passing through heat exchanger 16. The air leaving the warm end of the heat exchanger 16 is at 75° F. and is recycled to the inlet of recycle compressor 10 through conduit 50.

The high pressure column 25 separates the input (which comprises, by moles, 24% liquid and 71% gaseous air) into a crude liquid oxygen stream 26 containing 35% oxygen and a high purity nitrogen stream 32 containing 99.999% nitrogen. The crude liquid oxygen stream 26 at −278° F. is subcooled to −285° F. in subcooler 27. Any remaining hydrocarbons in the gas are then extracted by one of a pair of switching hydrocarbon adsorbers 28. The crude liquid oxygen is expanded to 30 psia at −302° F. in valve 29. The cold liquid oxygen is passed through heat exchanger 30 and introduced to low pressure column 31 at −307° F. Substantially pure liquid oxygen is drawn off the bottom of column 31 through line 62, is subcooled in heat exchanger 30 and is passed to storage tanks (not shown). Reflux for the low pressure column 31 is provided by taking a liquid fraction 42 from the high pressure column, cooling it in subcooler 27 and expanding the liquid through valve 43 where it forms a mixture comprising (in moles) 95% liquid.

The gaseous high purity nitrogen stream 32 is liquified in heat exhanger 33 which serves inter alia as reflux condenser for high pressure column 25 and reboiler for low pressure column 31. The liquid nitrogen stream leaving heat exchanger 33 is divided into a reflux stream and a product stream which is subcooled to −310° F. in subcooler 27. The product stream 63 is expanded to 20 psia at valve 34 and the liquid and gaseous nitrogen separated in separator 35. The liquid nitrogen product is passed to storage whilst the gaseous nitrogen is passed to gaseous nitrogen line 36 where it joins gaseous nitrogen from the top of low pressure column 31.

The gaseous nitrogen in gaseous nitrogen line 36, which is at −314° F. and 20 psia is used to subcool the liquid nitrogen and liquid oxygen streams in subcooler 27. The gaseous nitrogen leaves subcooler 27 at −280° F. and is then split into first and second substreams 37 and 38, respectively.

Substream 37 passes through a check valve 40 and is joined by a waste oxygen gas stream 41 (99.5% oxygen) drawn from the low pressure column 31. The combined streams are then passed through heat exchangers 18 and 16 and the emerging gas vented to atmosphere.

Substream 38 is passed through heat exchangers 18 and 16 and the warm nitrogen at about 75° F. is used for:

1. The continuous purge to the cold box 39 surrounding the equipment shown;
2. For regenerating switching molecular sieves 9;
3. For regenerating the switching adsorbers 28; and
4. For regenerating the quard adsorber 46.

The guard adsorber 46 is incorporated to ensure that there is no accumulation of hydrocarbons in the sump of the low pressure column 31. In use, a line 45 conveys liquid oxygen together with any hydrocarbons to adsorber 46. A small proportion of the liquid leaving adsorber 46 is vaporized in heat exchanger 47 and the mixture of liquid and vapor is returned to low pressure column 31. The heat exchanger 47 is used to induce a circulation of liquid through the adsorber 46 by a thermosyphon effect. A gaseous air fraction is withdrawn from the high pressure column 25 through line 44 and condensed in exchanger 47 to provide heat for the thermosyphon effect. The liquid is returned through line 48 to join the crude liquid oxygen stream 26.

The approximate relative flow rates in the various positions of the installation can be seen from the following details which are given in moles per hour and are based on a feed rate of 1000 moles per hour of dry, carbon dioxide free air leaving heat exchanger 6 en route for recycle compressor 10.

| | | moles per hour |
|---|---|---|
| Total | air entering recycle compressor | 1580 |
| " | air losses at compressor | 15 |
| " | air leaving recycle compressor | 1565 |
| " | air passing through first stream 12 | 723 |
| " | air passing through second stream 13 | 842 |
| " | air passing through expander 17 | 462 |
| " | air passing to HP column 25 via stream 23 | 724 |
| " | liquid & gas passing through valve 19 | 261 |
| " | recycle from expanders 17 and 22 | 580 |

The adsorber 46 is periodically regenerated by closing valves 52 and 53, opening valves 54 and 55 and passing nitrogen through the adsorber. Once the adsorber is regenerated, valves 54 and 55 are closed and valves 52 and 53 opened.

It will be appreciated that the switching molecular sieves 9 work in conventional manner, i.e., one sieve is on-stream extracting carbon dioxide and water vapor from the feed air whilst the other molecular sieve is regenerated.

Regeneration is accomplished by passing warm gaseous nitrogen through the sieve and subsequently cooling the sieve before returning it on-stream. Conveniently, the warm nitrogen can be obtained by closing valve 58, opening valve 59 and preheating the nitrogen in electric heater 60. After a predetermined time, valve 59 is closed and valve 58 is opened whereby nitrogen from substream 38 is cooled in heat exchanger 7 before passing through and cooling the molecular sieve before it is returned on-stream.

Refrigeration is supplied to heat exchanger 7 by a halo-carbon refrigeration unit 51.

Various modifications to the installation described with reference to the accompanying flowsheet are envisaged, for example the hydrocarbon adsorber 28 can be dispensed with if the molecular sieve 9 is suitably designed.

What is claimed is:

1. A method for producing at least one liquid product from the group of liquid oxygen and liquid nitrogen comprising the steps of:

(a) drying and removing carbon dioxide from a feed air stream to form a dry, carbon dioxide-free feed air stream;

(b) compressing said dry, carbon dioxide-free feed air stream in at least one recycle compressor to a pressure above 425 psia;

(c) dividing said compressed feed air stream into first and second feed air streams;

(d) dividing said first feed air stream into a sidestream and a remaining stream;

(e) expanding said sidestream to a lower pressure and temperature, and cooling said remaining stream and said second stream in heat exchange relationship with said expanded sidestream;

(f) expanding said second stream, after cooling in clause (e), to a lower pressure and temperature, and further cooling said once cooled remaining stream in heat exchange relationship with a first portion of said expanded second stream;

(g) expanding said twice cooled remaining feed air stream to a lower pressure, and injecting said expanded and cooled remaining feed air stream at least partially as a liquid, into a distillation column as a first feed air stream to the column;

(h) injecting a second portion of said expanded second stream into said distillation column as a second air feed stream to said column;

(i) recycling the exapnded streams of steps (e) and (f) to said recycle compressor as recycled feed air streams along with said initially dry carbon dioxide-free feed air stream;

(j) separating said first and second feed air streams in said distillation column and producing both liquid oxygen and liquid nitrogen in said column; and (k) withdrawing at least one of said liquid oxygen and liquid nitrogen from said distillation column as liquefied product.

* * * * *